US006532033B2

(12) United States Patent
Nanami

(10) Patent No.: US 6,532,033 B2
(45) **Date of Patent: *Mar. 11, 2003**

(54) HEAT DEVELOPMENT RECORDING APPARATUS AND HEAT DEVELOPMENT RECORDING METHOD

(75) Inventor: Shoji Nanami, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/382,625

(22) Filed: Aug. 25, 1999

(65) Prior Publication Data

US 2002/0054202 A1 May 9, 2002

(30) Foreign Application Priority Data

Aug. 25, 1998 (JP) ..... 10-238979

(51) Int. Cl.[7] ..... B41J 2/435

(52) U.S. Cl. ..... 347/228

(58) Field of Search ..... 347/228, 239, 347/255, 140; 358/518, 532, 296; 250/587, 341.6, 582; 382/260, 263, 264, 261, 132; 430/336, 350, 360, 510, 508, 522, 611; 396/575; 355/35

(56) References Cited

U.S. PATENT DOCUMENTS

| | | | | | |
|---|---|---|---|---|---|
| 4,315,318 | A | * | 2/1982 | Kato et al. | 382/264 |
| 4,356,398 | A | * | 10/1982 | Komaki et al. | 250/582 |
| 4,924,261 | A | * | 5/1990 | Okino | 355/35 |
| 5,046,147 | A | * | 9/1991 | Funahashi et al. | 250/587 |
| 5,063,146 | A | * | 11/1991 | Inagaki et al. | 430/522 |
| 5,238,799 | A | * | 8/1993 | Usami et al. | 430/522 |
| 5,319,719 | A | * | 6/1994 | Nakazawa et al. | 382/132 |
| 5,696,593 | A | * | 12/1997 | Chiba et al. | 358/296 |
| 5,716,775 | A | * | 2/1998 | Uehara et al. | 430/611 |
| 6,026,216 | A | * | 2/2000 | Ohtsuka et al. | 358/518 |
| 6,047,092 | A | * | 4/2000 | Moro | 382/261 |
| 6,155,726 | A | * | 12/2000 | Ishikawa et al. | 396/575 |

FOREIGN PATENT DOCUMENTS

JP 10-260518 9/1998

* cited by examiner

*Primary Examiner*—Hai Pham
(74) *Attorney, Agent, or Firm*—Sughrue Mion, PLLC

(57) ABSTRACT

A heat-development recording apparatus including a laser modulation section for modulating a laser beam in accordance with image data; an exposing section for scanning and exposing a heat development photosensitive material having photosensitivity with respect to a wavelength of not more than 750 nm with the modulated laser beam so as to form a latent image; and a heat development station for developing the exposed photosensitive material with heat, the heat-development recording apparatus including: a frequency processing section for processing image data, the frequency processing section being provided in front of the laser modulation section.

8 Claims, 8 Drawing Sheets

FIG. 3

N x N = 9

| | | |
|---|---|---|
| $P_0$ | $P_1$ | $P_2$ |
| $P_3$ | $P_4$ | $P_5$ |
| $P_6$ | $P_7$ | $P_8$ |

BLUR MASK $P_{new4}$ $$P_{new4} = P_4 + K(P_4 - q)$$

WHERE K: DEGREE OF EMPHASIS $$q = \frac{P_0 + P_1 + \sim + P_8}{N^2}$$

FIG. 4

INPUT DATA

| | | |
|---|---|---|
| $a_1$ | $a_2$ | $a_3$ |
| $a_4$ | $a_5$ | $a_6$ |
| $a_7$ | $a_8$ | $a_9$ |

N x N = 9

EMPHASIZING MASK

| | | |
|---|---|---|
| $k_1$ | $k_2$ | $k_3$ |
| $k_4$ | $k_5$ | $k_6$ |
| $k_7$ | $k_8$ | $k_9$ |

N x N = 9

EMPHASIZING-FREQUENCY $$(a_1 \times k_1) + (a_2 \times k_2) + (a_3 \times k_3) + (a_4 \times k_4) + (a_5 \times k_5) + (a_6 \times k_6) + (a_7 \times k_7) + (a_8 \times k_8) + (a_9 \times k_9)$$

HEAT DEVELOPMENT RECORDING APPARATUS AND HEAT DEVELOPMENT RECORDING METHOD

BACKGROUND OF THE INVENTION

1. Field of the Invention

The present invention relates to prevention of a blur caused for a heat-development recording apparatus, and more particularly to prevention of a blur caused for a medical laser printer.

2. Description of the Related Art

An image recording apparatus for recording a medical image for use in a digital radiography system, a CT, an MR or the like which uses a heat accumulating fluorescent sheet is known. The foregoing apparatus employs a wet system for obtaining a reproduced image by performing a wet process after an image has been photographed or recorded on a silver-salt photographic photosensitive material.

In recent years, a recording apparatus has attracted attention which employs a dry system which uses a heat development photosensitive material and in which the wet process is not performed.

FIG. 9 is a block diagram showing a conventional heat-development recording apparatus of the foregoing type.

Referring to FIG. 9, a film made of a heat development photosensitive material or the like is, in an exposing section 4, irradiated (scanned) with a laser beam modulated by a laser modulation section 3 in accordance with image data 1 so that a latent image is formed. Then, the exposed heat development photosensitive material is, in a heat development section 5, brought into contact with a heating means so that heat development is performed. As a result, an image is formed on the film.

Also the image recording apparatus which is the dry system performs a process for recording an image such that the photosensitive material is irradiated (scanned) with a laser beam so that a latent image is formed on the photosensitive material. Then, the photosensitive material having the latent image formed thereon is heated so that the latent image is developed. An exposing process is usually performed such that scanning (main-scanning) with a laser beam is performed while an output of the laser beam is being controlled in accordance with image data obtained by an individual photographing operation. As a matter of course, also the photosensitive material is moved (sub-scanned) in a predetermined direction during the exposing process.

FIG. 7 is an overall view showing a heat-development photosensitive material recording apparatus of the foregoing type which is a previous invention filed by the applicant of the present invention.

Referring to FIG. 7, an image forming apparatus 10 is an apparatus arranged to use a heat development photosensitive material (hereinafter called a "recording material A") which does not require the wet development process. Moreover, scanning exposure using laser beam L is performed to expose the recording material A to correspond to a required image so that a latent image is formed. Then, heat development is performed so that a visible image is obtained. The image forming apparatus 10 comprises a recording-material supply section 12, a width aligning section 14, an image exposing section 16 and heat development section 18 disposed in this order in a direction in which the recording material A is conveyed.

The recording-material supply section 12 has two sections having inside portions 22 and 24 to permit selective use of the recording materials A (for example, B4-size recording materials or half-cut recording materials) set in the foregoing sections through a magazine 100. The recording material A is a recording material on which an image is recorded (exposed) by the laser beam L and which is developed with heat to develop color. In accordance with a print command, an uppermost recording material A in the magazine 100 selected by suction cups 26 and 28 structured to suck each sheet is taken out in a state in which the cover of the magazine is opened. Then, the recording material A is guided by paired supply rollers 30 and 32, paired conveying rollers 34 and 36 and conveying guides 38, 40 and 42 disposed downstream in the conveying direction so as to be conveyed to the width aligning section 14.

The width aligning section 14 aligns the position of the recording material A with a direction (hereinafter called a "widthwise direction") perpendicular to the conveying direction. In the downstream image exposing section 16, the width aligning section 14 performs alignment of the recording material A in the main scanning direction, that is, so-called side regist. Then, a conveying roller pair 44 conveys the recording material A to the downstream image exposing section 16.

The downstream image exposing section 16 uses a laser beam to expose the recording material A to correspond to the image, the image exposing section 16 comprising an exposing unit 46 and a sub-scan conveying means 48.

FIG. 8 shows an example of the image exposing section 16.

Referring to FIG. 8, the image exposing section 16 incorporates:

(1) a first laser-beam source 50 having a semiconductor laser 50*a* for emitting laser beam L0 having a wavelength serving as a reference for a recording operation, a collimater lens 50*b* for converting the laser beams into a parallel luminous flux and a cylindrical lens 50*c;* and (2) a second laser-beam source 200 having a second semiconductor laser unit 20*a* for emitting laser beam L1 in a direction perpendicular to the direction of the optical axis of the first laser-beam source 50 and having a different wavelength from that of the first laser beam, a collimater leans 200*b* and a cylindrical lens 200C.

Light emitted from each of the laser-beam sources 50 and 200 is allowed to pass through a polarizing beam splitter 202 so as to be formed into superimposed beams. Then, the beams are allowed to pass through a reflecting mirror 204 so as to be made incident on a polygonal mirror 54. When the polygonal mirror 54 is rotated, the laser beam is applied in a main scanning direction b through a fθ lens 56 and a cylindrical mirror 58 while the laser beam is being polarized.

In response to an input image signal, a control unit (not shown) operates a driver 52 so as to rotate a conveying motor 206 provided for a polygonal mirror (a rotative polygonal mirror) 54 and a roller pair 60, 62. Thus, while the recording material A is being scanned in the main scanning direction b with the laser beam, the recording material A is conveyed in a sub-scanning direction a.

The foregoing superimposition optical system has been described as an example. As a matter of course, the present invention is not limited to the foregoing system. Although a semiconductor laser beam is employed in the foregoing description, the present invention is, as a matter of course, not limited to this. Another laser beam, for example, He—Ne laser beam may, of course, be employed.

As a result, while the recording material A is being sequentially conveyed in the sub-scanning direction by the conveying motor 206 provided for the roller pair 62, a latent image is formed on the surface of the recording material A in the main scanning direction.

Referring again to FIG. 7, then, the recording material A caused to have the latent image formed by the image exposing section 16 shown in FIG. 8 is conveyed to the heat development section 18 by conveying roller pairs 64, 66 and 132.

The heat development section 18 is a section for heating the recording material A to perform the heat development to convert the latent image into a visible image. A plate heater 320 accommodated in the heat development section 18 includes a heating member which is a plate-like heating member including a heating member, such as a nichrome wire, which is laid flatly. Thus, the development temperature for the recording material A is maintained. As shown in the drawing, the plate heater 320 projects upwards. Moreover, there are provided a supply roller 326 serving as a conveying means for relatively moving the recording material A with respect to the plate heater 320 while making contact the recording material A with the surface of the plate heater 320; and a pressing roller 322 which transmits heat from the plate heater 320 to the recording material A and disposed adjacent to the lower surface of the plate heater 320.

Moreover, a heat insulating cover 325 for maintaining the temperature is disposed opposite to the plate heater 320 of the pressing roller 322.

As a result of the foregoing structure, the recording material A passes through a space between the pressing roller 322 and the plate heater 320 by dint of the conveying rotations of the supply roller 326. Then, the heat treatment is performed so that the recording material A is developed with heat. Then, the exposure process is performed so that the recorded latent image is converted into a visible image. Since the conveyance is performed such that the leading end of the recording material A is pressed against the plate heater 320, buckling of the recording material A can be prevented.

Although the plate heater has been described, the present invention is not limited to this. A means which uses another heat development method, for example, a heat drum+belt type means may, of course, be employed.

The recording material A discharged from the heat development section 18 is, by a conveying roller pair 140, guided to a guide plate 142. Then, the recording materials A are accumulated in a tray 146.

The heat development photosensitive material, which is the recording material A, will now be described.

FIG. 10 is a cross sectional view showing the heat development photosensitive material. Referring to FIG. 10, the material incorporates, from the surface on which the laser beam is made incident (the upper portion of the drawing), a PC layer, which is a surface protective layer for protecting an image forming layer and preventing adhesion; an Em (emulsion) layer; a PET layer which is a support-member layer and which is usually made of PET; a halation preventive AH layer; and a backcoat BC layer.

The Em layer is an image forming layer formed on the surface of the support-member layer on which the laser beam L is made incident and containing a binder composed of latex at a ratio of 50% or higher and a reducing agent which is organic silver salt. When the image forming layer is exposed to incident laser beam L, a photocatalyst, such as photosensitive silver halide, forms a core for a latent image. When the core of the latent image is heated, the action of the reducing agent moves silver of the ionized organic silver salt so as to be bonded with the photosensitive silver halide and formed into crystal silver with which an image is formed. As the organic silver salt, silver salt of an organic acid, preferably silver salt of long-chain fatty carboxylic acid having 10 to 30 carbon atoms and organic or inorganic silver salt, the ligant of which has a stability factor coefficient of complex of 4.0 to 10.0 are exemplified. Specifically, the following materials are exemplified: silver salt of behenic acid, silver salt of arachidic acid, silver stearate, silver olerate, silver laurate, silver caproate, silver myristate, silver palmitate, silver maleate, silver fumarate, silver tartrate, silver linoleate, silver butyrate and silver camphorate. The image forming layer of the recording material contains a material, for example, photosensitive silver halide (hereinafter called "silver halide) which is converted into a photocatalyst after it has been exposed to light.

The image forming layer of the recording material or another layer on the same surface of the image forming layer may contain an additive which is known as a tone adjuster in a preferred quantity of 0.1 mol % to 50 mol % with respect to one mol of silver to raise the optical density. Note that the tone adjuster may be a precursor induced to have an effective function only when the development process is performed. The tone adjuster may be any one of a variety of known tone adjusters for use in the recording material. Specifically, the following materials are exemplified: a phthalimide compound, such as phthalimide or N-hydroyphthalimide; cyclic imide, such as succinimide, pyrazoline-5-on; naphthalic imide, such as N-hydroxy-1,8-naphthalic imide; cobalt complex, such as cobalt hexamine trifluoroacetate; mercaptan, such as 3-mercapto-1,2,4-triazole or 2,4-dimercaptopyrimidine; phthalazinone derivative, such as 4-(1-naphtyl)phthalazinone; and its metal salt. The foregoing tone adjuster is added to the solution, which must be applied, as solution, powder or dispersed solid particles.

The sensitizing coloring matter must be capable of spectrosensitizing silver halide in a required wavelength region when the sensitizing coloring matter has been adsorbed to silver halide particles. To add the sensitizing color matter to the silver halide emulsion, it may directly be dispersed in the emulsion or it may be dissolved in single or a mixed solution of water, methanol, ethanol, N,N-dimethylformamide or the like, followed by adding the solution to the emulsion.

The surface protective PC layer is formed by an adhesion preventive material exemplified by wax, silica particles, elastomer-type block copolymer containing styrene (styrene-butadiene-styrene or the like), cellulose acetate, cellulose acetate butylate and cellulose propionate.

When the halation preventive dye is employed, any compound capable of satisfying the following requirement may be employed: the dye must be capable of performing required absorption in the wavelength and; the absorption must sufficiently be restrained in the visible region after the process has been completed; and a preferred absorbance spectrum shape can be obtained. Although the following materials are exemplified, the material is not limited to the following materials. As single dye, compounds disclosed in Japanese Patent Laid-Open No. 7-11432 and Japanese Patent Laid-Open No. 7-13295 are exemplified. As dyes which perform decoloration by carrying out processes, compounds disclosed in Japanese Patent Laid-Open No. 52-139136 and Japanese Patent Laid-Open No. 7-199409 are exemplified. It is preferable that the foregoing recording material has the image forming layer on either surface of the support member and a back layer on another surface.

To improve conveyance easiness, a matting agent may be added to the back BC layer. In general, the matting agent is in the form of particles of organic or inorganic compound which is dissoluble in water. The preferred organic compound is exemplified by water dissoluble vinyl polymer, such as polymethylacrylate, methyl cellulose, carboxy starch and carboxy nitrophenyl starch. The preferred inorganic compound is exemplified by silicon dioxide, titanium dioxide, magnesium dioxide, aluminum oxide and barium sulfate.

The binder for forming the back layer may be any one of a variety of colorless, transparent or semitransparent resins. The resin is exemplified by gelatin, arabic rubber, polovinyl alcohol, hydroxyethyl cellulose, cellulose acetate, cellulose acetate butylate, casein, starch, poly (metha)acrylate, polymethylmethacrylate and polyvinyl chloride.

It is preferable that the back layer is a layer, the maximum absorption is 0.3 to 2 in a required wavelength range. If necessary, the halation preventive dye for use in the foregoing antihalation layer may be added to the back layer.

A system of the foregoing type for recording an image on the transmission-type photosensitive material by using a laser beam suffers from a problem of deterioration in the sharpness owning to halation (scattering, reflection and transmission) of a laser beam in the photosensitive material. The deterioration in the sharpness can be overcome by coating the portion including the emulsion layer with a material for absorbing the laser beam. In a case of the wet-type photosensitive material, dye which is capable of absorbing scattering and reflecting portions is added in a large quantity to prevent a blur so as to prevent scatting and reflection. Since the dye can be removed by washing which is performed after the exposure and development, any critical problem has not been raised.

When an image is recorded on the heat development photosensitive material by using a laser beam, cyan dye for absorbing red visible rays is added because the laser beam is a visible ray (in red). Since the washing process cannot be employed because it is not the wet type, excessive addition of the cyan dye in order to prevent halation causes the lowest density to undesirably be raised. As a result, the quality of the image deteriorates. Thus, a lowest density required to perform a diagnosis of an image in the medical field cannot be realized. If the quantity of the cyan dye is too small, a high sharpness cannot be obtained. Thus, simultaneous achievement of the required lowest density and the high sharpness has been difficult.

In the heat development photosensitive material, as shown in FIG. 10, an original photosensitive region A in the emulsion layer Em is exposed with a laser beam. Then, the laser beam is reflected by the backcoat layer BC, causing unnecessary halation which forms a photosensitive region B to occur. Therefore, dye is added to absorb the laser beam so as to prevent the halation. Since the dye must be decolored, a halation preventive layer is formed into which the dye is added in place of addition of the dye to the Em layer. Thus, the laser beam is absorbed. Since the halation preventive layer is provided for the back surface, the laser beam can be absorbed to prevent halation. Then, the halation preventive layer is decolored and made to be transparent by performing the heat development. Although the foregoing technique has been known, the deterioration in the sharpness cannot completely be prevented in spite of a somewhat acceptable result.

SUMMARY OF THE INVENTION

Accordingly, an object of the present invention is to provide a heat-development recording apparatus and a heat-development recording method which are capable of effectively prevent deterioration in the sharpness without a necessity of raising the lowest density.

To achieve the foregoing object, according to one aspect of the present invention, there is provided a heat-development recording apparatus comprising: a laser modulation section for modulating a laser beam in accordance with image data; an exposing section for scanning and exposing a heat development photosensitive material having photosensitivity with respect to a wavelength of not more than 750 nm with the modulated laser beam so as to form a latent image; and a heat development section for developing the exposed photosensitive material with heat, the heat-development recording apparatus comprising: a frequency processing section for processing image data, the frequency processing section being provided in front of the laser modulation section.

The frequency processing section may process image data with respect to the characteristics of the photosensitive material.

The frequency processing section may perform a frequency emphasizing process in such a range that a spatial frequency is no less than substantially 0.01 c/mm and a frequency emphasizing degree is substantially no more than two times.

According to another aspect of the present invention there is provided a heat-development recording material for use in the heat-development recording apparatus, wherein the heat-development recording material contains, on a support member thereof, organic silver salt, a reducing agent, a silver halide and a binder.

According to another aspect of the present invention, there is provided a heat-development recording material for use in the heat-development recording apparatus, wherein the heat-development recording material is coated with halation preventive density which is decolored in a post process which is performed after an exposing process has been completed.

The adsorbance of the halation preventive density which is decolored in the post process which is performed after the exposing process has been completed may be 1.0 or smaller with respect to the wavelength of a light source.

According to another aspect of the present invention, there is provided a heat-development recording method arranged to scan and expose a heat development photosensitive material having a photosensitivity with respect to a wavelength of 750 nm or shorter by using a laser beam moderated in accordance with image data so as to form a latent image and develop the latent image with heat, the heat-development recording method comprising the steps of: performing a frequency process of image data to correct a quantity of deterioration in the sharpness; and modulating the laser beam.

As a result of the above-mentioned structures, image data is initially subjected to the frequency emphasizing process so that the quantity of deterioration in the sharpness is previously corrected. Therefore, the deterioration in the sharpness can be corrected without a necessity of raising the lowest density in addition to the effect of the decoloring process of the halation preventive process.

Since the frequency emphasizing process is performed to a degree corresponding to the adsorbance of a laser beam of the emulsion layer of the photosensitive material, an image adaptable to the photosensitive material and having a high quality can be obtained without considerable irregularity and artifact.

Other objects, features and advantages of the invention will be evident from the following detailed description of the preferred embodiments described in conjunction with the attached drawings.

BRIEF DESCRIPTION OF THE DRAWING

FIG. 3 is diagram showing a blur masking process which is performed by the frequency emphasis processing section shown in FIG. 1;

FIG. 4 is a diagram showing a digital filter process which is prevented by the frequency emphasis processing section shown in FIG. 1;

DESCRIPTION OF THE PREFERRED EMBODIMENTS

A first embodiment of the present invention will now be described with reference to the drawings.

Figure 1:
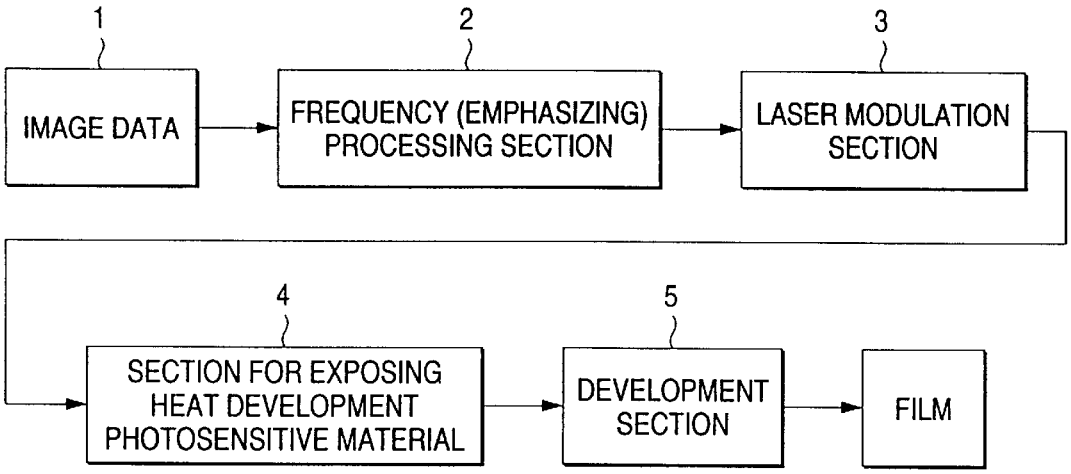
FIG. 1 is a block diagram showing a heat-development recording apparatus according to a first embodiment of the present invention.

FIG. 1 is a block diagram showing a heat-development recording apparatus according to the first embodiment of the present invention.

Figure 2:
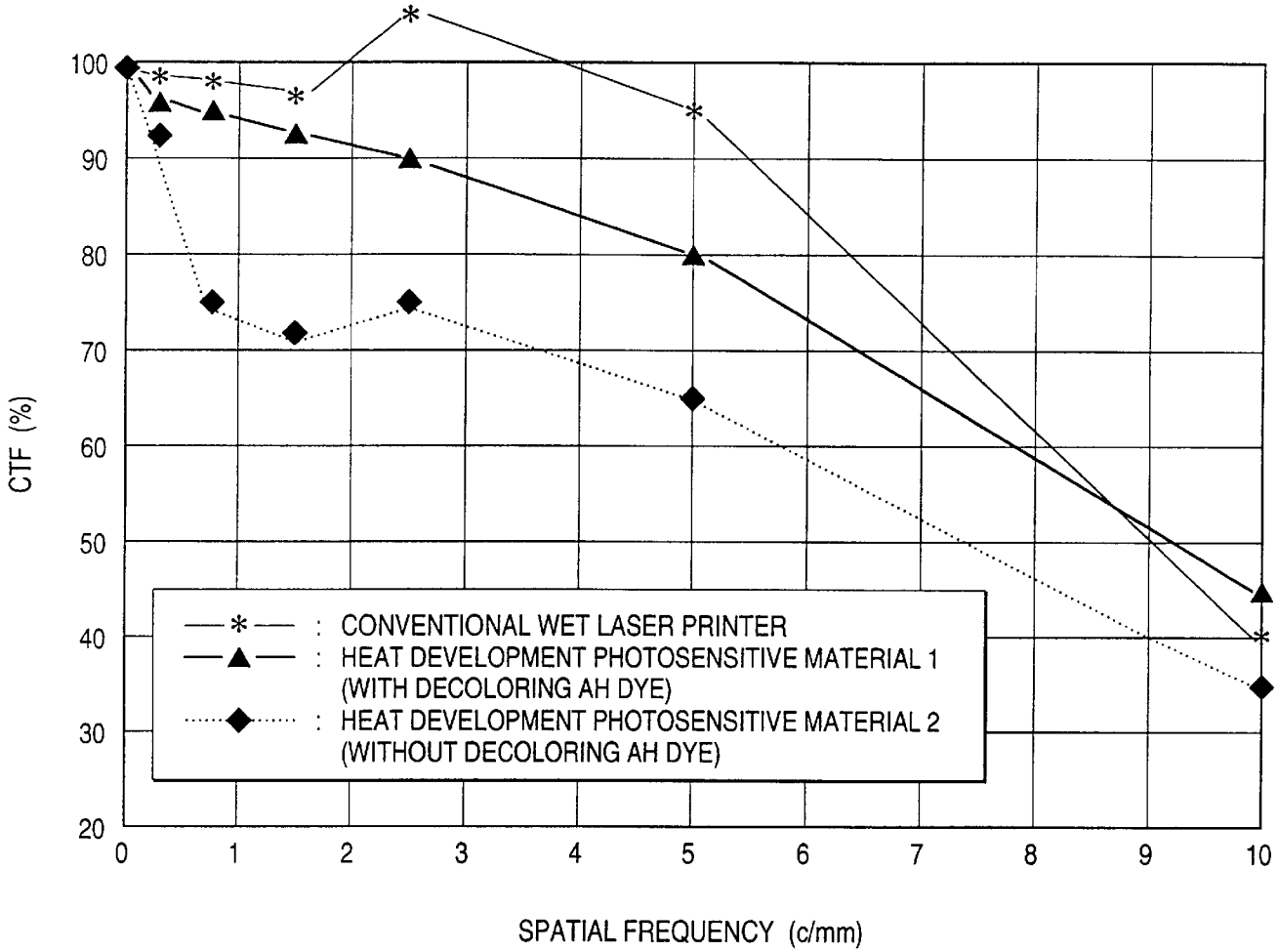
FIG. 2 is a graph showing sharpness of each of a variety of photosensitive materials for use in the heat-development recording apparatus shown in FIG. 1.

FIG. 2 is a graph showing sharpness of each of a variety of photosensitive materials for use in the heat-development recording apparatus shown in FIG. 1.

FIG. 3 is diagram showing a blur masking process which is performed by the frequency emphasis processing section shown in FIG. 1.

FIG. 4 is a diagram showing a digital filter process which is prevented by the frequency emphasis processing section shown in FIG. 1.

Figure 5:
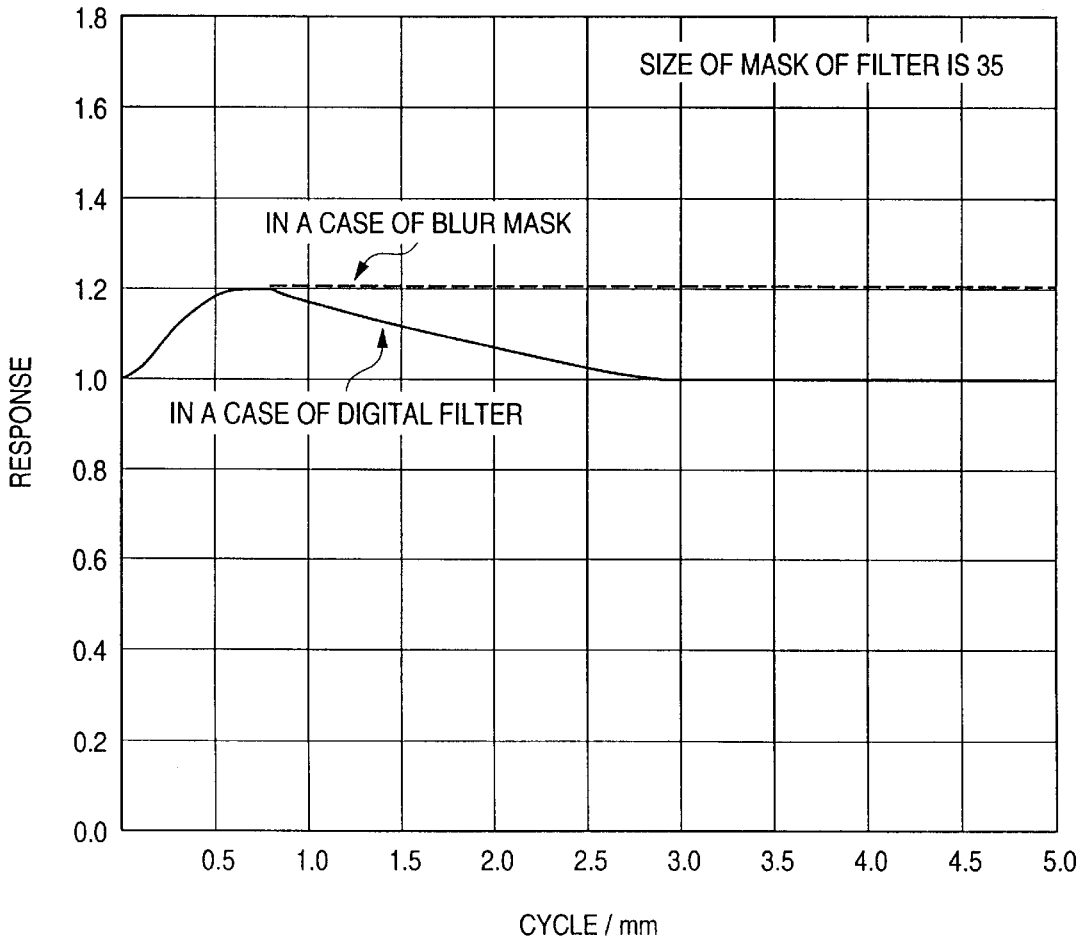
FIG. 5 is a graph showing a filter characteristic of the frequency processing section shown in FIG. 1.

FIG. 5 is a graph showing a filter characteristic of the frequency emphasis processing section shown in FIG. 1.

Figure 6:
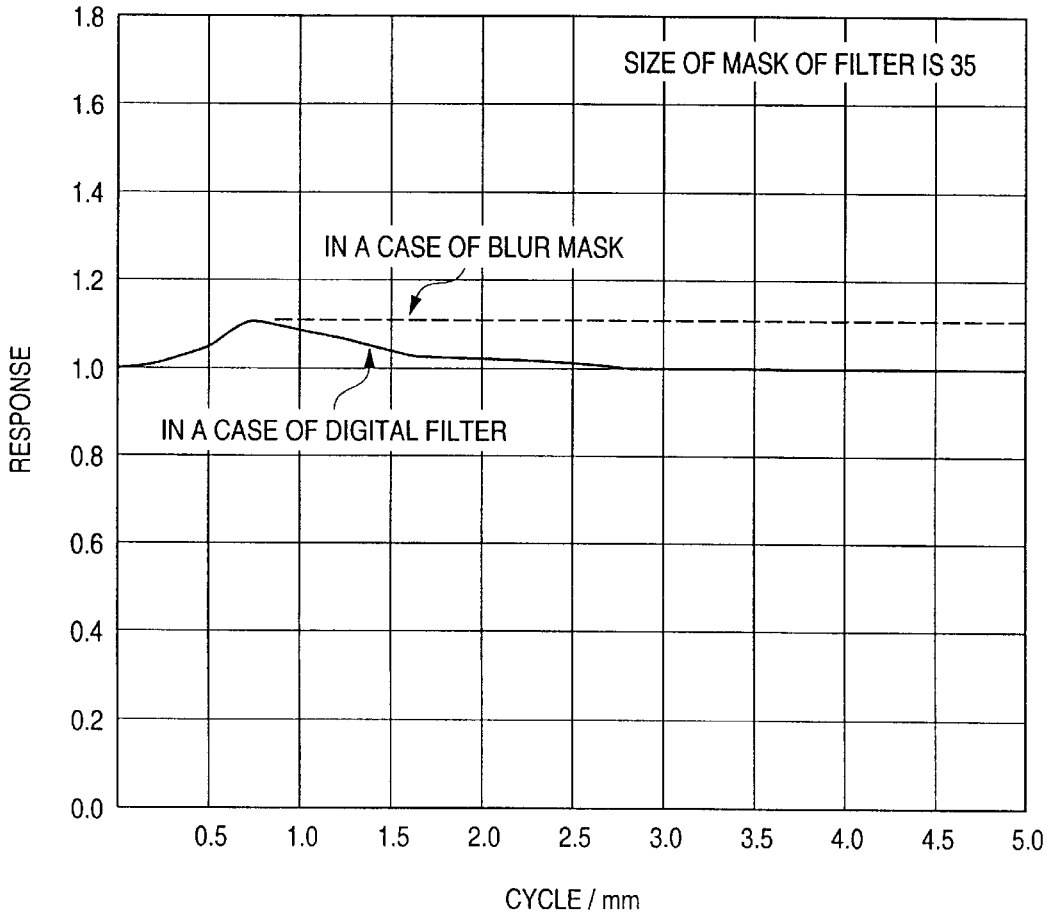
FIG. 6 is a graph showing a filter characteristic in a case where the degree of emphasis of the characteristic shown in FIG. 5 is restrained.

FIG. 6 is a graph showing a filter characteristic in a case where the degree of emphasis of the characteristic shown in FIG. 5 is restrained.

Referring to FIG. 1, reference numeral 1 represents image data of a medical apparatus, such as a digital radiography, CT or MR. Reference numeral 2 represents a frequency emphasis processing section for performing an image process, represented by a blur masking process, by converting the frequency. In the present invention, a frequency emphasizing process is performed to correct a degree of deterioration in the sharpness. Reference numeral 3 represents a laser modulation section for modulating an exposing laser beam in accordance with image data. Reference numeral 4 represents a section for exposing a heat development photosensit material such that exposure of a heat development photosensitive material is exposed to a laser beam. The heat development photosensitive material has layers made of organic salt, a reducing agent, silver halide and a binder formed on a support member made of PET or the like. Moreover, a halation preventive layer is formed by coating. Reference numeral 5 represents a development section for bringing the exposed heat development photosensitive material to a heating means to perform heat development.

Figure 9:
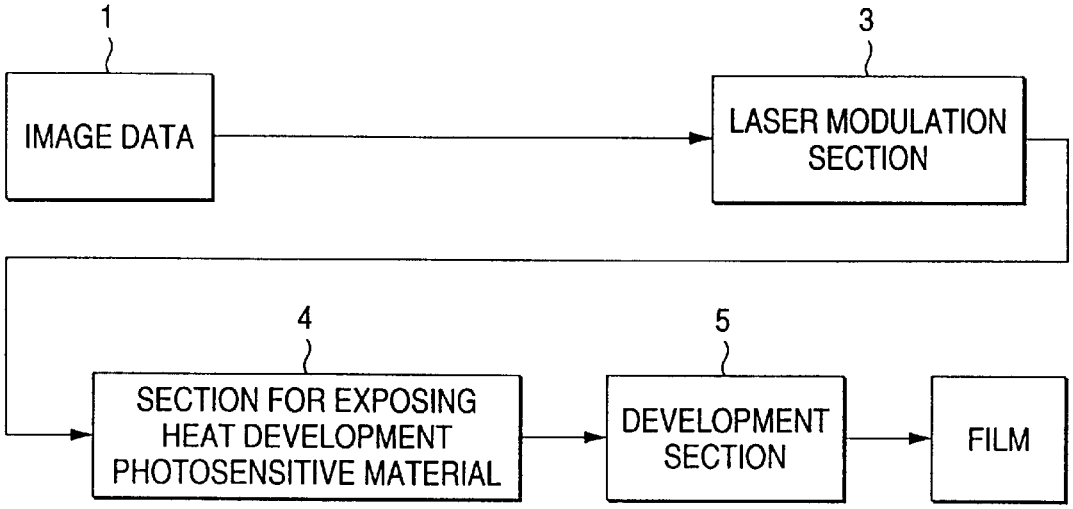
FIG. 9 PRIOR ART
FIG. 9 is a block diagram showing a conventional heat-development recording apparatus.
Figure 10:
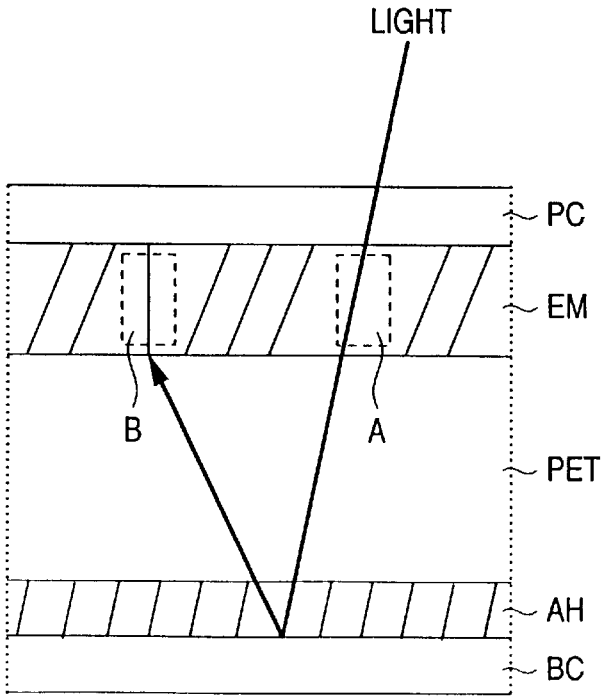
FIG. 10 is a cross sectional view showing a heat-development photosensitive material.

As can be understood from a result of a comparison with a conventional example shown in FIG. 9, the structure according to this embodiment and shown in FIG. 1 is formed such that the frequency processing section 2 for processing image data 1 is provided in front of the laser modulating section 3 which modulates a laser beam in accordance with image data 1.

FIG. 2 is a graph showing sharpness (CTF%) of each of a variety of photosensitive materials and having an axis of ordinate standing for spatial frequencies (c/mm) and an axis of abscissa standing for sharpness (CTF%).

(1) An uppermost graph having symbols "*" indicates CTF of a conventional wet laser printer.

(2) A graph having "▲" indicates heat development photosensitive material 1 (containing decoloring AH dye).

(3) A graph having "◆" indicates heat development photosensitive material 2 (without the decoloring AH dye).

As can be understood from FIG. 2, the material comprising the decoloring AH dye has improved CTF as compared with the material having no decoloring AH dye. However, the CTF of the foregoing material is inferior to that of the wet laser printer. As can be understood from FIG. 2, the CTF in a low frequency region in the vicinity of 1.0 c/mm is lower than that of the wet laser printer.

The operation of this embodiment will now be described.

The heat development photosensitive material according to the first embodiment incorporates a support member (made of PET or the like) which is coated with the organic salt, the reducing agent, the silver halide and the binder. Moreover, the halation preventive layer is formed by coating a halation preventive material which can be decolored after an exposing process has been completed. The heat development photosensitive material according to this embodiment has a photosensitivity with respect to a wavelength of 750 nm or lower. As shown in FIG. 2, the CTF of the material containing the decoloring AH dye is inferior to that of the wet laser printer. Therefore, the degree of deterioration in the sharpness is previously raised in an average manner by the blur masking process which is performed by the frequency emphasis processing section 2. Then, the digital filter process is performed to emphasize a low frequency region in the vicinity of 1.0 c/mm so that correction is carried out. A specific correction process will now be described.

The blur (non-sharpness) masking process is, as shown in FIG. 3, performed such that image data (a mask is assumed which is expressed by N rows×N columns=3×3=9 around a central pixel P4) of a supplied image is subjected to the following process. The process is the frequency emphasizing process (the blur masking process) which is expressed by, Pnew4=P4+K (P4−q), so that new pixel Pnew4 is produced. In this equation, q is a blur masking signal obtained by dividing, with nine, a value obtained by adding nine input pixels P0 to P8. Thus, q=P0 + . . . +P8/N×N, where K is an emphasizing coefficient indicating the degree of emphasizing which is classified into a linear case and a non-linear case.

The digital filter process is, as shown in FIG. 4, performed such that (an assumption is made that supplied image data and the mask for emphasizing the frequency are N×N=3×3=9) supplied image data a1 to a9 are subjected to the filter processes by frequency emphasizing masks k1 to k9. Thus, the following frequency emphasizing process is performed: (a1×k1)+ . . . +(a9×k9).

Although the masks for use in the blur masking process and the digital filter process are N×N=3×3=9, the masks and the method of the filter process are not limited to the foregoing structures.

Results of the frequency emphasizing process using the foregoing filter are shown in FIG. 5.

FIG. 5 shows filter characteristics such that the axis of abscissa stands for spatial frequencies and the axis of ordinate stands for gains.

(1) The reason why the spatial frequency is made to be 0.01 c/mm or higher lies in that blurs in a low frequency region raise problems and, therefore, the spatial frequencies of 0.01 c/mm or higher must be emphasized.

(2) The reason why the degree of emphasizing the frequency is two times or smaller lies in that the excessive degree of emphasis raises a problem of the artifact (abnormal image). To prevent the artifact, the degree of the emphasis must be two times or smaller.

The results shown in FIG. 5 were obtained by making the degree of emphasizing the frequency to be 1.2 and the emphasized low frequency region to be a region in the vicinity of 0.5 c/mm to 1.0 c/mm to correspond to the CTF shown in FIG. 2.

In accordance with the foregoing results, the blur mask emphasizing coefficient K and the digital filter coefficient k are determined. Since enlargement of the size of the mask improves the effect of the filter in the low frequency region, the size of the mask of the example shown in FIG. 5 is 35.

Also FIG. 6 shows filter characteristics similar to those shown in FIG. 5. In the present invention, the frequency emphasizing process adapted to the laser adsorbance (for example, 0.67, 0.8 or the like) of the emulsion layer Em of the photosensitive material is performed. Therefore, the degree of emphasizing the frequency is, in the case shown in FIG. 6, reduced to correspond to the photosensitive material as compared with the degree shown in FIG. 5. That is, the degree of the emphasis is made to be about 1.1. To correspond to the photosensitive material, the mask coefficients K and k are varied in the present invention.

Although each equation is expressed by the one-dimensional equation, the final process includes a main (a horizontal) and sub (a vertical) processes because the image process is a two-dimensional process.

A second embodiment of the present invention will now be described.

The process according to the first embodiment is structured such that both of the main direction and the sub-direction are subjected to the digital process. The second embodiment is structured such that the process in the main direction is a peaking and filter process of a usual analog circuit. The-process is performed with limitations such that the range in which the frequency is emphasized is 0.01 c/mm or larger and the degree of emphasizing the frequency is two times or smaller. The process in the sub-direction is a digital filter process similar to that according to the first embodiment. A final process of synthesis is performed so that image data is obtained.

The foregoing method is a convenient method because the process can be divided into the digital process and the analog process to correspond to the output form (an image displayed on a CRT, an image of a printed photograph or the like) of image data.

Note that the actual structure of the hardware including the filter circuit is not limited. Any hardware with which a predetermined characteristic can be obtained may be employed.

As a result of the correction using the frequency embodiment processes according to the first and second embodiments, the degree of deterioration in the sharpness (in particular, in the low frequency region) is corrected by the filter process as shown in FIGS. 5 and 6. Thus, an image having a high quality can be obtained which is free from artifact.

Figure 7:
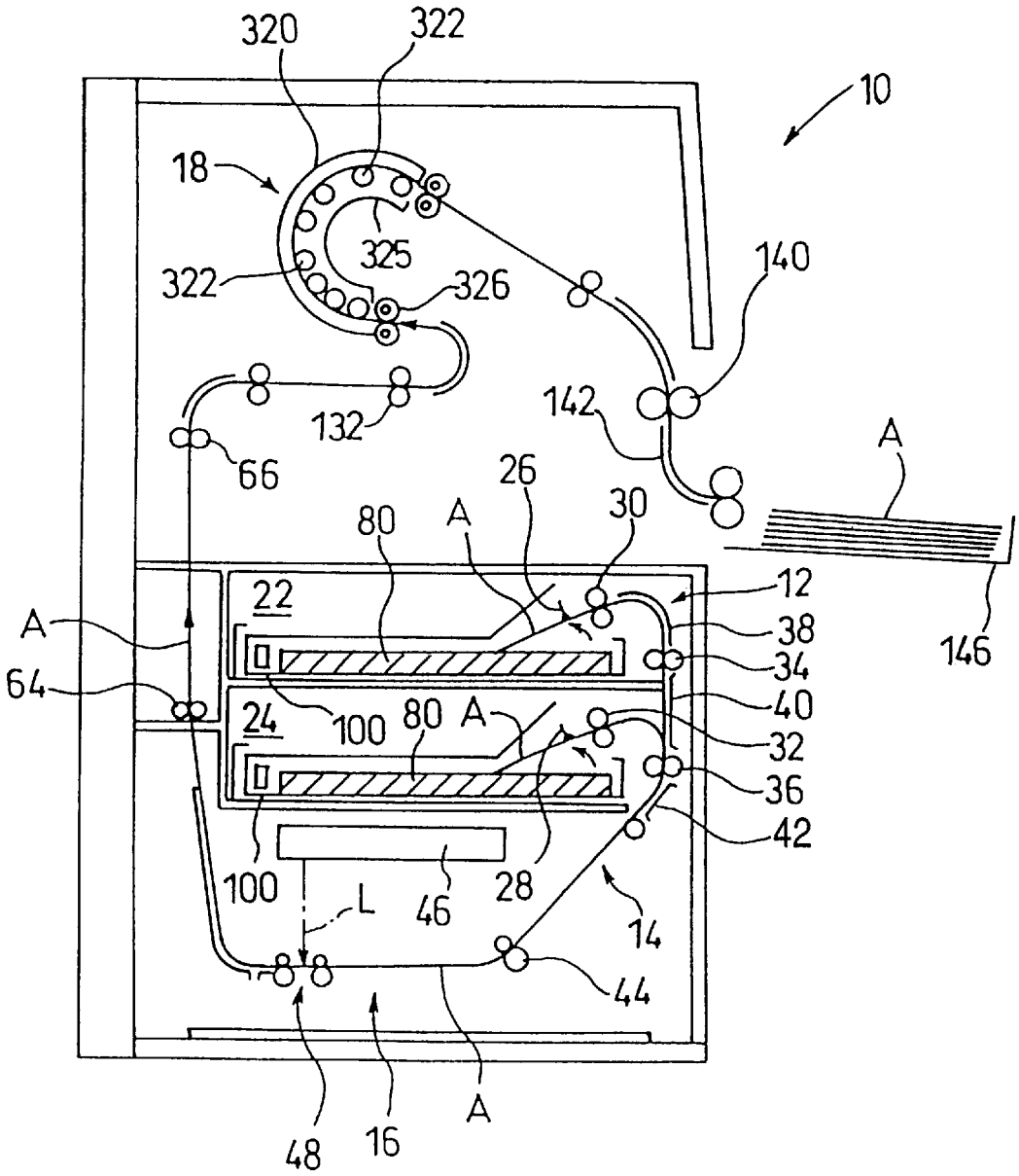
FIG. 7 PRIOR ART
FIG. 7 is diagram showing the overall body of a heat-development recording apparatus according to a preceding invention of the applicant of the present invention.
Figure 8:
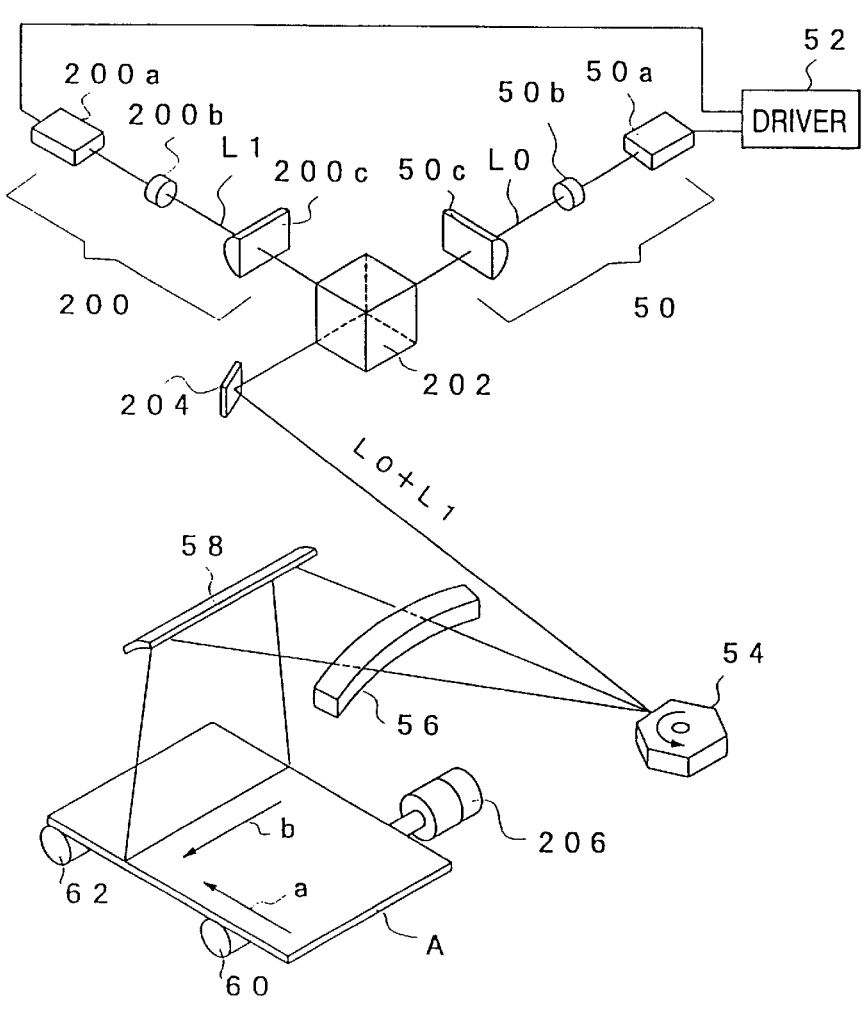
FIG. 8 PRIOR ART
FIG. 8 is a diagram showing the exposing section shown in FIG. 7.

When the above-mentioned process for emphasizing the frequency of image data 1 has been completed, the laser beam is modulated by the laser modulating section 3 in accordance with image data. Then, the exposure is performed in the exposing section 4 of the heat-development recording apparatus (see FIG. 7), and then the heat development section 5 performs the heat development.

As described above, the sharpness is previously corrected by performing the frequency emphasizing process, and then precise exposure using the laser beam and heat development are performed. As a result, an image free from artifact can be obtained.

As described above, according to the present invention, there is provided the heat-development recording apparatus for exposing the heat development photosensitive material having the photosensitivity with respect to the wavelength of 750 nm or lower, the heat-development recording apparatus has the frequency processing section for processing image data to correct the sharpness. Therefore, an effect can be obtained in that deterioration in the sharpness can be prevented without a necessity of raising the lowest density.

Since the frequency processing section performs the process for emphasizing image data to be adaptable to the characteristic of the photosensitive material, an effect can be obtained in that a frequency process adaptable to the laser adsorbance of the photosensitive material is performed to obtain an image having a high quality exhibiting a sharpness free from any irregularity and free from artifact.

Although the invention has been described in its preferred form and structure with a certain degree of particularity, it is understood that the present disclosure of the preferred form can be changed in the details of construction and in the combination and arrangement of parts without departing from the spirit and the scope of the invention as hereinafter claimed.

What is claimed is:

1. A heat-development recording apparatus comprising:

a laser modulation section for modulating a laser beam in accordance with image data;

an exposing section for scanning and exposing a heat development photosensitive material, having photosensitivity of which wavelength is no more than 750 nm, by using the modulated laser beam so as to form a latent image;

a heat development section for developing the exposed photosensitive material with heat; and a frequency processing section for processing image data, which is disposed in front of said laser modulation section, wherein said frequency processing section processes the image data with respect to the characteristics of the photosensitive material.

2. A heat-development recording apparatus according to claim 1, wherein said frequency processing section performs a frequency emphasizing process in such a range that a spatial frequency is no less than substantially 0.01 c/mm and a frequency emphasizing degree is substantially no more than two times.

3. A heat-development recording material for use in the heat-development recording apparatus according to claim 1, wherein the heat-development recording material contains, on a support member thereof, organic silver salt, a reducing agent, a silver halide and a binder.

4. A heat-development recording material for use in the heat-development recording apparatus according to claim 1, wherein said heat-development recording material is coated with halation preventive dye which is decolored in a post process which is performed after an exposing process has been completed.

5. A heat-development recording material according to claim 4, wherein adsorbance of the halation preventive dye, which is decolored in the post process after the exposing process has been completed, is no more than 1.0 with respect to the wavelength of a light source.

6. A heat-development recording apparatus according to claim 1, wherein the frequency processing section processes the image in a digital filtering process.

7. A heat-development recording apparatus according to claim 1, wherein said frequency processing section includes means for reducing blurring due to halation.

8. A heat-development recording method for use with a heat development photosensitive material having a photosensitivity with respect to a wavelength of not more than 750 nm, said heat-development recording method comprising the steps of:

processing image data using a mask and a mask emphasizing coefficient to produce frequency emphasized image data that prevents a quantity of deterioration in the sharpness;

modulating a laser beam in accordance with the frequency emphasized image data;

using the modulated laser beam to scan and expose the heat development photosensitive material, to form a latent image; and heat developing the latent image, wherein said step of processing image data using the mask and the mask emphasizing coefficient to produce the frequency emphasized image data includes a reducing of blurring due to halation.

* * * * *